US007921558B2

(12) United States Patent
Beamer et al.

(10) Patent No.: US 7,921,558 B2
(45) Date of Patent: Apr. 12, 2011

(54) NON-CYLINDRICAL REFRIGERANT CONDUIT AND METHOD OF MAKING SAME

(75) Inventors: Henry E. Beamer, Middleport, NY (US); Bruce W. Dittly, North Tonawanda, NY (US); Michael D. Ford, Amherst, NY (US); Thomas McGreevy, Akron, NY (US); David E. Samuelson, Wheatfield, NY (US); Douglas C. Wintersteen, Burt, NY (US)

(73) Assignee: Delphi Technologies, Inc., Troy, MI (US)

( * ) Notice: Subject to any disclaimer, the term of this patent is extended or adjusted under 35 U.S.C. 154(b) by 200 days.

(21) Appl. No.: 12/327,965

(22) Filed: Dec. 4, 2008

(65) Prior Publication Data

US 2009/0173483 A1 Jul. 9, 2009

Related U.S. Application Data

(60) Provisional application No. 61/020,066, filed on Jan. 9, 2008.

(51) Int. Cl.
*B23P 15/26* (2006.01)
*F28F 9/02* (2006.01)

(52) U.S. Cl. ..... 29/890.043; 29/890.052; 165/174

(58) Field of Classification Search ..... 165/174; 29/890.043, 890.052
See application file for complete search history.

(56) References Cited

U.S. PATENT DOCUMENTS

| | | | | |
|---|---|---|---|---|
| 1,684,083 | A | 9/1928 | Bloom | |
| 2,099,186 | A * | 11/1937 | Anderegg | 165/174 |
| 2,357,156 | A * | 8/1944 | Wilson | 165/174 |
| 2,759,248 | A * | 8/1956 | Burgess | 29/890.052 |
| 3,196,943 | A * | 7/1965 | Haerter | 165/174 |
| 3,254,707 | A * | 6/1966 | Ferguson | 165/174 |
| 3,976,128 | A * | 8/1976 | Patel et al. | 165/174 |
| 4,593,539 | A | 6/1986 | Humpolik et al. | |
| 5,203,407 | A * | 4/1993 | Nagasaka | 165/174 |
| 5,479,784 | A | 1/1996 | Dobmeier et al. | |
| 5,513,700 | A | 5/1996 | Kleve et al. | |
| 5,592,830 | A | 1/1997 | Baba et al. | |
| 5,806,586 | A | 9/1998 | Osthues et al. | |
| 6,154,960 | A | 12/2000 | Baldantoni et al. | |
| 6,814,136 | B2 * | 11/2004 | Yi et al. | 165/174 |

(Continued)

FOREIGN PATENT DOCUMENTS

GB 2250336 A * 6/1992

(Continued)

*Primary Examiner* — Leonard R Leo

(74) *Attorney, Agent, or Firm* — Patrick M. Griffin

(57) ABSTRACT

A heat exchanger assembly includes an outlet header extending along an outlet axis to define an outlet cavity and an inlet header defining an inlet cavity. A plurality of refrigerant tubes extends from the inlet header through the outlet header and into the outlet cavity. A collector conduit having a generally semi-circular conduit cross-section defining an arced surface and a chord surface interconnected with rounded ends is disposed in the outlet header and includes a conduit body portion and at least one conduit end portion interconnected by a conduit transition portion with the conduit body portion being offset from the conduit end portion. The conduit body portion is engaged to an interior surface of the outlet header to space the conduit body portion from the refrigerant tubes and the conduit end portion is coaxial with the outlet header axis to provide a central outlet for the refrigerant vapor.

29 Claims, 8 Drawing Sheets

U.S. PATENT DOCUMENTS

| | | | | |
|---|---|---|---|---|
| 6,993,838 | B1 * | 2/2006 | Staffa et al. | 29/890.052 |
| 7,000,690 | B2 | 2/2006 | Auchter et al. | |
| 7,025,126 | B1 | 4/2006 | Wyatt et al. | |
| 7,343,966 | B2 | 3/2008 | Nitta | |
| 7,484,555 | B2 * | 2/2009 | Beamer et al. | 165/174 |
| 7,549,466 | B2 * | 6/2009 | Hayashi et al. | 165/174 |
| 7,819,177 | B2 * | 10/2010 | Beamer et al. | 165/174 |
| 2007/0039724 | A1 * | 2/2007 | Trumbower et al. | 165/174 |
| 2007/0256821 | A1 * | 11/2007 | Mashiko et al. | 29/890.052 |
| 2008/0023183 | A1 * | 1/2008 | Beamer et al. | 165/174 |
| 2008/0023184 | A1 * | 1/2008 | Beamer et al. | 165/174 |
| 2008/0023185 | A1 * | 1/2008 | Beamer et al. | 165/174 |
| 2008/0078541 | A1 * | 4/2008 | Beamer et al. | 165/174 |
| 2010/0089095 | A1 * | 4/2010 | Macri et al. | 165/174 |
| 2010/0089559 | A1 * | 4/2010 | Gorbounov et al. | 165/174 |

FOREIGN PATENT DOCUMENTS

JP 06159983 A * 6/1994

* cited by examiner

NON-CYLINDRICAL REFRIGERANT CONDUIT AND METHOD OF MAKING SAME

CROSS-REFERENCE TO RELATED APPLICATIONS

This application claims the benefit of U.S. Provisional Patent Application Ser. No. 61/020,066 for a Non-Cylindrical Refrigerant Conduit and Method of Making Same, filed on Jan. 9, 2008, which is hereby incorporated by reference in its entirety.

BACKGROUND OF THE INVENTION

1. Field of the Invention

The subject invention relates generally to a heat exchanger and method of fabricating the same, and, more specifically, to a heat exchanger of the type including a plurality of refrigerant tubes extending between an inlet header and an outlet for transferring refrigerant from the inlet header to the outlet header and including a refrigerant conduit disposed in at least one of the headers for uniformly distributing the refrigerant.

2. Description of the Prior Art

Due to their high performance, automotive style brazed heat exchangers are being developed for residential air conditioning and heat pump applications. Automotive heat exchangers typically utilize a pair of headers with refrigerant tubes defining fluid passages to interconnect the headers. Residential heat exchangers are typically larger than automotive heat exchangers and generally require headers that are two to five times longer than the typical automotive heat exchangers. In such heat exchangers, uniform refrigerant distribution is necessary for optimal performance. To improve refrigerant distribution, refrigerant conduits can be disposed in the headers. An example of such a heat exchanger is disclosed in U.S. Pat. No. 1,684,083 to S. C. Bloom.

The Bloom patent discloses a first header being at least in part generally cylindrical in cross-section to define a first cavity extending parallel to a first header axis between a pair of first header end portions. A second header defining a second cavity extends along a second header axis between a pair of second header end portions. A plurality of refrigerant tubes each defining a fluid passage extends transversely to the header axes between the headers. The fluid passages of the refrigerant tubes are in fluid communication with the cavities for transferring refrigerant from one of the headers to the other of the headers. A refrigerant conduit having a conduit cross-section being circular is disposed in each of the cavities extending axially along the header axes parallel to the headers. The refrigerant conduits include a plurality of orifices in fluid communication with the associated cavities for transferring refrigerant between the refrigerant conduits and the associated cavities. One of the headers is an inlet header for receiving liquid refrigerant and the other of the headers is an outlet header for outputting refrigerant vapor. The refrigerant conduit disposed in the inlet header insures a uniform and even distribution of the refrigerant throughout the inlet header while the refrigerant conduit disposed in the outlet header insures only dry gas is withdrawn from the outlet header via the refrigerant conduit by a pump.

A heat exchanger as disclosed by the Bloom patent is typically made by puncturing a generally cylindrical first header defining a first cavity and a generally cylindrical second header defining a second cavity in predetermined spaced intervals axially along each header to define a plurality of header slots spaced axially along each header. A plurality of orifices is produced in a generally cylindrical refrigerant conduit, and the refrigerant conduit is inserted into the first cavity of the first header. The first and second headers are then placed in a stacker headering station fixture, and the headers are pressed onto a plurality of refrigerant tubes each defining a fluid passage to fluidly communicate the cavities of the headers. The refrigerant tubes typically extend through the header slots and into the cavities of the headers.

The increasing length of residential heat exchangers have created both manufacturing and performance problems with such heat exchangers as disclosed by the prior art. The increasing length has made it more difficult to insert a refrigerant conduit into a header without damaging the refrigerant tubes or the refrigerant conduit. Additionally, the increasing length has produced increasing problems with refrigerant maldistribution. Refrigerant maldistribution in a heat exchanger can be caused by both inlet maldistribution as well as the longitudinal pressure drop of the refrigerant conduit. Accordingly, there remains a need for an improved heat exchanger which is easier to manufacture and which provides for more uniform refrigerant distribution.

SUMMARY OF THE INVENTION AND ADVANTAGES

The present invention provides such a heat exchanger assembly including a refrigerant conduit having a conduit cross-section being generally semi-circular to define an arced surface and a chord surface and further improved by the refrigerant conduit defining a conduit body portion and at least one conduit end portion having a circular cross-section, with the conduit body portion being offset from the conduit end portion and a conduit transition portion interconnecting the conduit body portion and the conduit end portion.

The present invention also provides an improved method of fabricating a heat exchanger assembly including a refrigerant conduit having a conduit cross-section and defining a conduit body portion and an offset conduit end portion by flattening a portion of the generally cylindrical refrigerant conduit to define the conduit cross-section as being generally semi-circular with an arced surface and a chord surface by offsetting the conduit end portion of the refrigerant conduit from the conduit body portion of the refrigerant conduit before inserting the refrigerant conduit into the first cavity.

Accordingly, the present invention improves refrigerant distribution within a heat exchanger by increasing the cross-sectional area of the refrigerant conduit to decrease the fluid flow velocity of a refrigerant in the refrigerant conduit to decrease the pressure drop along the refrigerant conduit.

The present invention also improves the manufacturability of a heat exchanger having a refrigerant conduit by spacing the conduit body portion from the refrigerant tubes.

The present invention also improves the manufacturability of a heat exchanger by allowing the conduit body portion of the refrigerant conduit to be inserted into a header while being supported against the header instead of having to support a refrigerant conduit extending coaxially along the header.

The present invention also improves the manufacturability of a heat exchanger by providing a refrigerant conduit having a conduit end portion establishing a central opening for the refrigerant vapor for being compatible with traditional, symmetrical end caps.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE EXEMPLARY EMBODIMENT

Referring to the Figures, wherein like numerals indicate corresponding parts throughout the several views, a heat exchanger assembly 20 for dissipating heat is shown generally.

Figure 1:
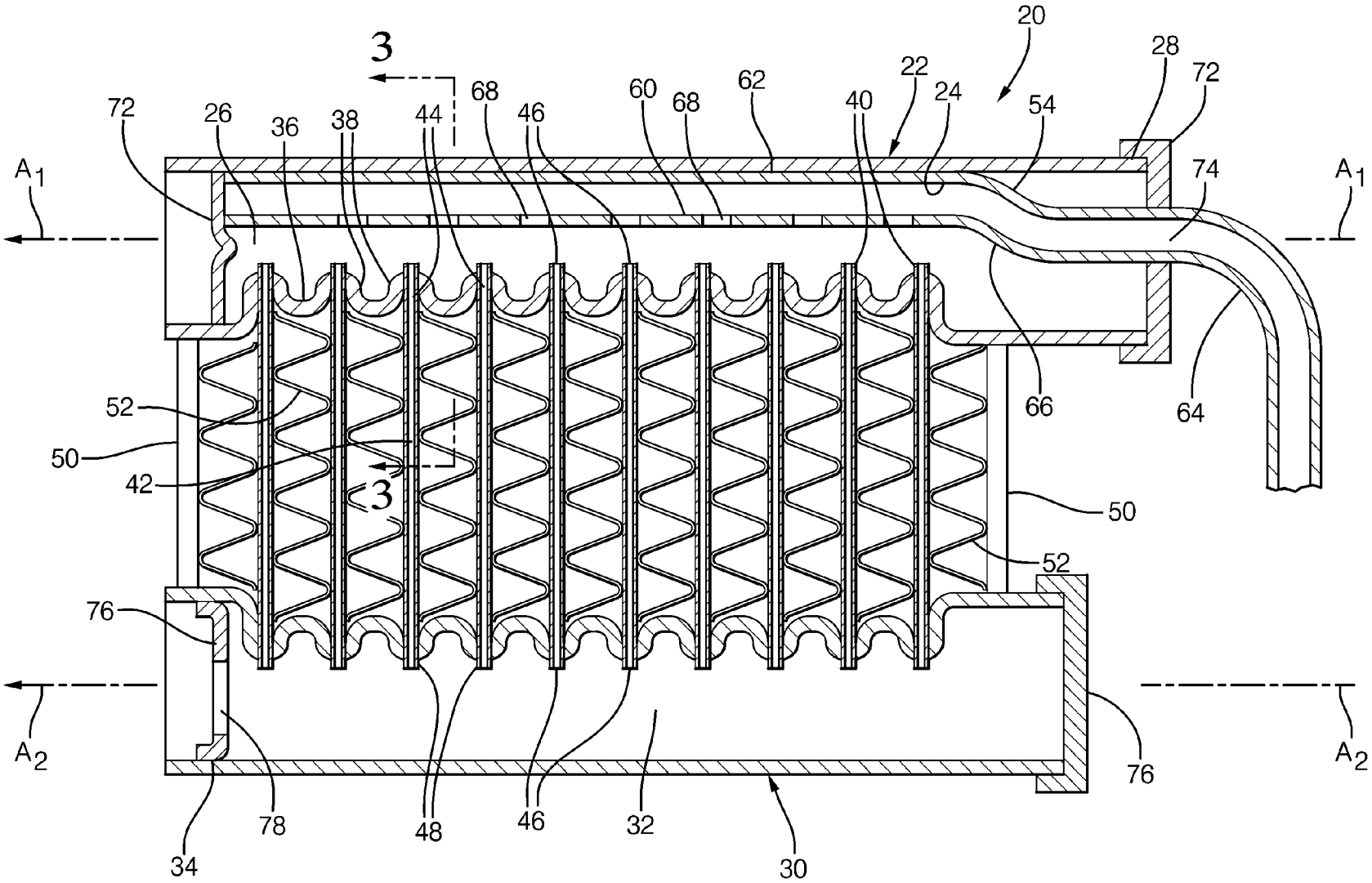
FIG. 1 is a cross-sectional view of an embodiment of the heat exchanger assembly showing the conduit body portion offset from the conduit end portion.

The heat exchanger assembly 20 comprises a first header 22, generally indicated, having an interior surface 24 and being generally cylindrical in cross-section to define a first cavity 26 extending along a first header axis $A_1$ between a pair of first header end portions 28. A second header 30 is generally indicated and defines a second cavity 32 extending along a second header axis $A_2$ between a pair of second header end portions 34. As shown in FIG. 1, the second header axis $A_2$ is generally parallel to the first header axis $A_1$. Hereinafter, an exemplary embodiment of the assembly 20 is described wherein the first header 22 is further defined as an outlet header 22 and the second header 30 is further defined as an inlet header 30. However, it is to be understood that in additional embodiments of the heat exchanger assembly 20 the first header 22 can be an inlet header 30 and the second header 30 can be an outlet header 22. In the exemplary embodiment, the outlet header 22 further defines the first cavity 26 as an outlet cavity 26 extending along an outlet header axis $A_1$ between a pair of outlet header end portions 28 and the inlet header 30 further defines the second cavity 32 as an inlet cavity 32 extending along an inlet header axis $A_2$ between a pair of inlet header end portions 34. In the exemplary embodiment, the inlet header 30 is for receiving a refrigerant for liquid-to-vapor transformation and the outlet header 22 is for collecting refrigerant vapor.

Each header includes a lanced surface 36 being flat and extending parallel to the corresponding header axis $A_1$, $A_2$ between the corresponding header end portions 28, 34. As shown in FIG. 1, each lanced surface 36 includes a plurality of truncated projections 38 extending into the corresponding cavity and being axially spaced from one another between the corresponding header end portions 28, 34 to define valleys between adjacent truncated projections 38 and defining a plurality of header slots 40 extending transversely to the header axes $A_1$, $A_2$.

Figure 2:
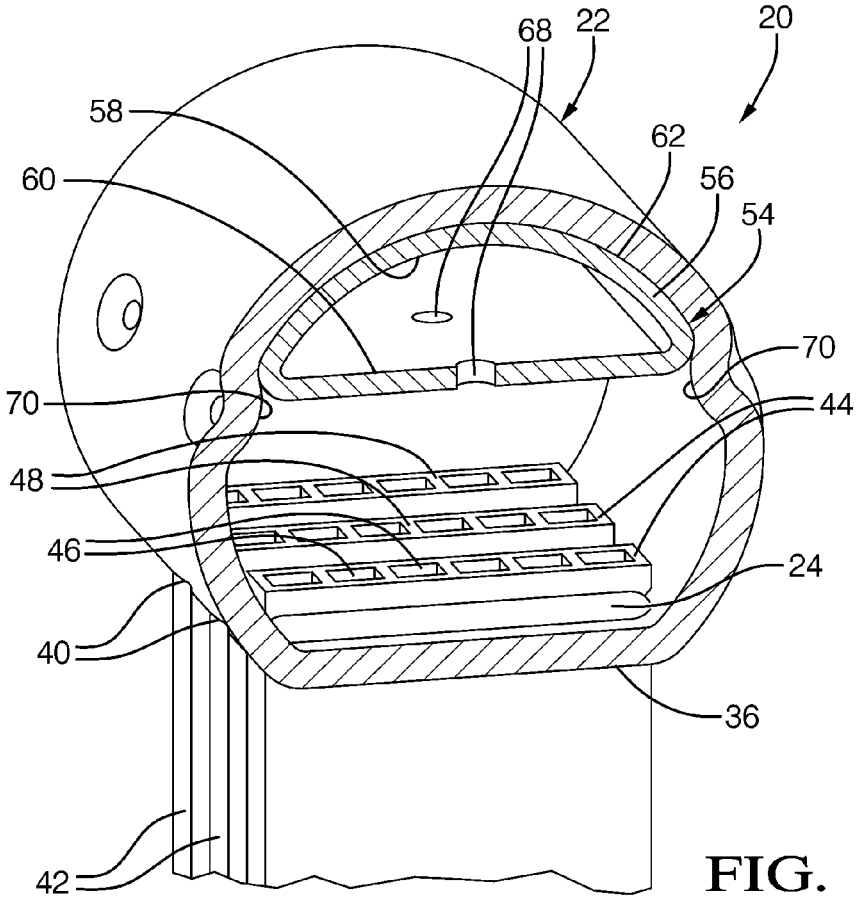
FIG. 2 is a perspective, fragmentary, and cross-sectional view of the heat exchanger assembly shown in FIG. 1 along 2-2 showing the refrigerant conduit having a conduit cross-section being generally semi-circular.
Figure 3:
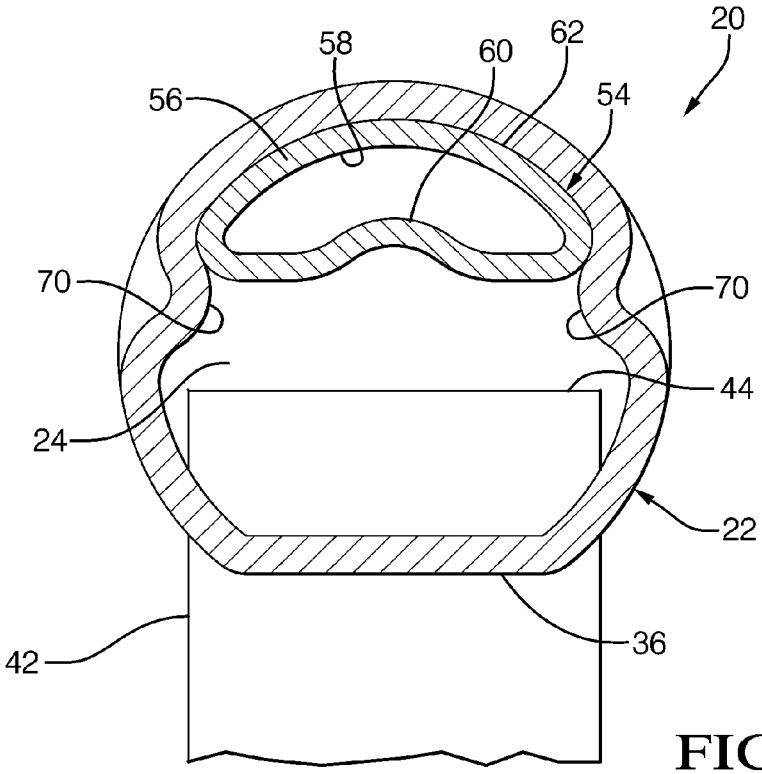
FIG. 3 is a cross-sectional view of an embodiment of the heat exchanger assembly showing the chord surface of the refrigerant conduit being arcuate.

A plurality of refrigerant tubes 42 each extend in a spaced and parallel relationship and transversely to the header axes $A_1$, $A_2$ between the headers 22, 30. Each of the refrigerant tubes 42 has a generally rectangular cross-section and extends between a pair of refrigerant tube ends 44 and defines a fluid passage 46 extending between the refrigerant tube ends 44. Those skilled in the art appreciate that in additional embodiments of the assembly 20 the refrigerant tubes 42 can have an oval cross-section or a circular cross-section. Each fluid passage 46 is in fluid communication with the cavities 26, 32 for transferring refrigerant from the inlet cavity 32 to the outlet cavity 26. As shown in FIG. 2, each refrigerant tube 42 generally includes at least one divider 48 defining a plurality of the fluid passages 46 extending between the refrigerant tube ends 44 and being in fluid communication with the cavities 26, 32. The refrigerant dividers add structural support for supporting the refrigerant tubes 42 during extreme pressures. As shown in FIG. 3, the refrigerant tube ends 44 of each refrigerant tube 42 generally extend through one of the header slots 40 of each header 22, 30 and into the corresponding cavity 26, 32.

In an embodiment of the assembly 20 as shown in FIG. 1, a pair of core reinforcements 50 are disposed outwards of the refrigerant tubes 42 and extend between the headers 22, 30 in a parallel and spaced relationship to the refrigerant tubes 42. The core reinforcements 50 add structural support to the heat exchanger assembly 20 and protect a plurality of cooling fins 52.

The plurality of cooling fins 52 are disposed between adjacent refrigerant tubes 42 and between each core reinforcement 50 and the next adjacent of the refrigerant tubes 42, as shown in FIG. 1, for transferring heat from the refrigerant tubes 42. The cooling fins 52 may be serpentine fins or any other cooling fins commonly known in the art.

A refrigerant conduit 54 is generally indicated and has a generally uniform cross-section. In the exemplary embodiment, the refrigerant conduit 54 is disposed in the outlet cavity 26 and extends along the outlet header axis $A_1$. In such an exemplary embodiment, the refrigerant conduit 54 is defined as a collector conduit 54. However, it is to be understood that in alternative embodiments, the refrigerant conduit 54 is disposed in the inlet header 30 defining the refrigerant conduit 54 as a distributor conduit. In additional embodiments, a refrigerant conduit 54 is disposed in each header.

The conduit cross-section 56 is generally semi-circular defining an arced surface 58 and a chord surface 60 interconnected with rounded ends. The semi-circular cross-section of the collector conduit 54 maximizes the cross-sectional area of the collector conduit 54 in the outlet header 22 to decrease the fluid flow velocity of the refrigerant vapor in the collector conduit 54 to decrease the pressure drop along the collector conduit 54 to provide more uniform refrigerant distribution along the length of the collector conduit 54. In an embodiment of the heat exchanger assembly 20 as shown in FIG. 2, the chord surface 60 is parallel to the refrigerant tube ends 44 extending through the header slots 40 of the outlet header 22. In another embodiment of the heat exchanger assembly 20 as shown in FIG. 3, the chord surface 60 is arcuate and extends away from the refrigerant tube ends 44 extending through the header slots 40 and into the outlet cavity 26 and towards the arced surface 58.

The collector conduit 54 defines a conduit body portion 62 and at least one conduit end portion 64. The conduit transition portion 66 interconnects the conduit body portion 62 and the conduit end portion 64. The transition portion 66 increases in cross-sectional area from the conduit body portion 62 and the conduit end portion 64.

The conduit body portion 62 generally extends along the outlet header axis $A_1$ between the outlet header end portions 28 and the conduit end portion 64 generally extends along the outlet header axis $A_1$ in one of the outlet header end portions 28. The arced surface 58 of the conduit body portion 62 is preferably engaged to the interior surface 24 of the cylindrical outlet header 22 as shown in FIG. 2, and the chord surface 60 of the conduit body portion 62 is preferably spaced from the refrigerant tube ends 44 extending through the header slots 40 and into the outlet cavity 26. The conduit end portion 64 preferably extends coaxially along the outlet header axis $A_1$ in one of the outlet header end portions 28 as shown in FIG. 1.

The collector conduit 54 includes a plurality of orifices 68 in fluid communication with the outlet cavity 26 for transferring the refrigerant vapor from the outlet cavity 26 to the collector conduit 54 to flow the refrigerant vapor along the collector conduit 54. In alternative embodiments of the assembly 20, a distributor conduit includes a plurality of orifices 68 in fluid communication with the inlet cavity 32 for transferring refrigerant from the distributor conduit to the inlet cavity 32.

As shown in FIG. 2, the outlet header 22 includes a plurality of support projections 70 extending into the outlet cavity 26 under the collector conduit 54 for positioning the collector conduit 54. In an embodiment of the assembly 20, as shown in FIG. 2, the support projections 70 are spaced from one another and aligned in two rows each parallel to the outlet header axis $A_1$. In another embodiment of the assembly 20, the support projections 70 extend axially along the outlet header 22 parallel to the outlet header axis $A_1$. In additional embodiments of the assembly 20, internal clips are disposed in the outlet cavity 26 in lieu of, or in addition to, the support projections 70 for supporting the collector conduit 54.

Figure 8:
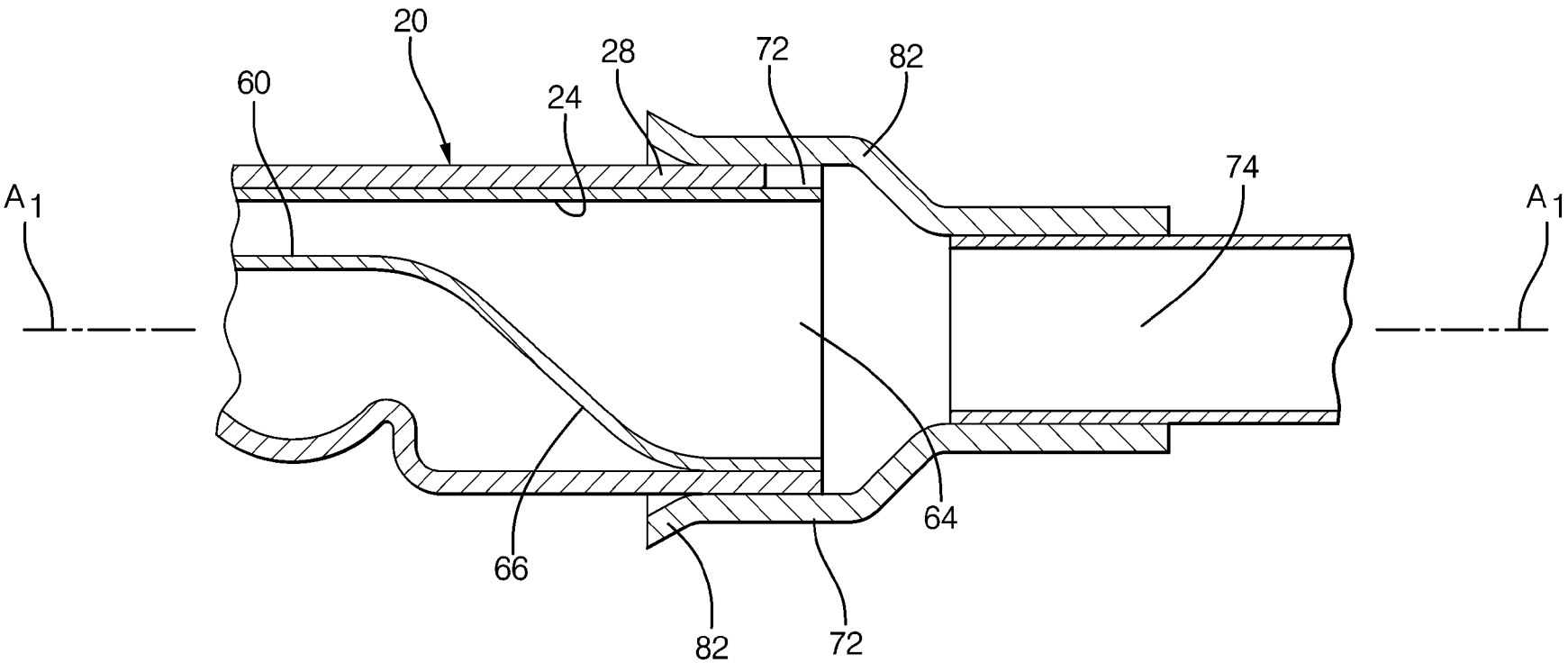
FIG. 8 is a perspective view of the conduit and the conduit end portion being connected by a transition portion and including an end flare and tapered end cap.

Each of a pair of first end caps 72 are engaged and hermetically sealed to one of the outlet header end portions 28 and to the collector conduit 54. In the exemplary embodiment, the first end caps 72 are outlet end caps 72. At least one of the outlet end caps 72 defines a first aperture 74, being an outlet aperture 74 in the exemplary embodiment, in fluid communication with the conduit end portion 64 of the collector conduit 54 for venting the refrigerant. The outlet end caps 72 can be internal to the outlet header 22 or external to the outlet header 22 as shown in FIG. 1. In the embodiment shown in FIG. 8, one of the first end caps 72 may be tapered to abut the first aperture 74 for reducing the pressure drop across said conduit end portion 64 and said first aperture 74. The conduit end portion 64 has a larger diameter than the aperture 72. Further, an end flare 82 is disposed around and connected to the conduit header 28 and the first aperture 74 of first end cap 72.

Each of a pair of second end caps 76 are engaged and hermetically sealed to one of the inlet header end portions 34. In the exemplary embodiment, the second end caps 76 are inlet end caps 76. At least one of the inlet end caps 76 defines a second aperture 78, being an inlet aperture 78 in the exemplary embodiment, in fluid communication with the inlet cavity 32 for receiving the refrigerant. The inlet end caps 76 can be internal to the outlet header 22 or external to the outlet header 22 as shown in FIG. 1. A hermetical seal is only necessary at the outlet header end portion.

A method for fabricating a heat exchanger assembly 20 having a non-cylindrical refrigerant conduit 54 and a pair of outlet header end portions 28 of a generally cylindrical outlet header 22 defining an outlet cavity 26 and a pair of inlet header end portions 34 of a generally cylindrical inlet header 30 defining an inlet cavity 32. In the preferred embodiment, the headers 22, 30 are made of aluminum.

One of a pair of outlet end caps 72 is sealed about one of the outlet header end portions 28 of the outlet header 22 to seal the outlet cavity 26 about one of the outlet header end portions 28. The outlet end cap 72 can be sealed externally or internally to the outlet header end portion 28. In an embodiment of the heat exchanger assembly 20, the outlet end cap 72 is aluminum for facilitating brazing. In another embodiment of the heat exchanger assembly 20, the outlet end cap 72 is copper for allowing the use of thinner gage for facilitating the formation of more intricate shapes. For brazed joints it is preferred to have aluminum over copper so that the aluminum will shrink into the copper due to its higher coefficient of thermal expansion as the joint cools down from the joining process.

The outlet header 22 and the inlet header 30 are punctured in predetermined spaced intervals axially along each header 22, 30 to define a plurality of header slots 40 spaced axially along each header 22, 30. In the preferred embodiment, the headers 22, 30 are punctured with a lance to define the header slots 40 to prevent the production of slugs, to provide easier bonding, and to add reinforcement. In additional embodiments, the headers 22, 30 can be drilled or punched to define the header slots 40.

The method includes the step of cutting a generally cylindrical tube to define a collector conduit 54 having a conduit cross-section 56 and a conduit body portion 62 and a conduit end portion 64. The collector conduit 54 is generally cut from welded, folded, or extruded tubing. Extrusions are relatively expensive but provide the flexibility to vary wall thickness and incorporate other features not easily fabricated by other means.

A plurality of orifices 68 are produced in the collector conduit 54. The orifices 68 are generally punched, drilled, or lanced. The sizing and spacing of the orifices 68 can be varied along the length of the refrigerant conduit 54 to achieve uniform refrigerant distribution throughout the heat exchanger assembly 20.

A portion of the generally cylindrical collector conduit 54 is flattened to define the conduit cross-section 56 as being generally semi-circular defining an arced surface 58 and a chord surface 60. In the embodiment of the invention as shown in FIG. 3, the method also includes the step of forming a groove in the flattened portion of the refrigerant conduit 54 to define the chord surface 60 as being arcuate. The conduit cross sectional area may be varied by varying the depth of the groove along the length of the conduit 54.

The conduit end portion 64 of the collector conduit 54 is offset from the conduit body portion 62 of the refrigerant conduit 54.

The method includes the step of inserting the collector conduit 54 into the outlet cavity 26 of the outlet header 22. The collector conduit 54 is generally positioned with one end of the collector conduit 54 abutting the outlet end cap 72 that is sealed about the outlet header 22. The method generally also includes the steps of engaging the arced surface 58 of the conduit body portion 62 of the collector conduit 54 with the outlet header 22 and positioning the conduit end portion 64 of the collector conduit 54 centrally in the other of the outlet header end portions 28. Positioning the conduit end portion 64 centrally in the other of the outlet header end portion 28 provides for the use of traditional, symmetrical end caps.

In an embodiment of the assembly 20, the method includes the step of producing a pair of support projections 70 each extending along the outlet header 22 and into the outlet cavity 26 for contacting and supporting the collector conduit 54. In another embodiment of the invention, the method alternatively includes the step of producing a plurality of support projections 70 spaced from one another and aligned in two rows on the outlet header 22 each row extending axially along the outlet header 22 and into the outlet cavity 26 for contacting and supporting the collector conduit 54.

The method includes the step of fluidly communicating the conduit end portion 64 of the collector conduit 54 with an outlet aperture 74 defined by the other of the pair of outlet end caps 72. The other of the pair of outlet end caps 72 is sealed about the other of the outlet header end portions 28 and about the conduit end portion 64 of the collector conduit 54 to seal the outlet cavity 26 about the other of the outlet header end portions 28. The other of the outlet end caps 72 can be sealed externally or internally to the other of the outlet header end portions 28. An additional support projection may be disposed on the end caps 72 to support the collector conduit 54, as shown in FIG. 1. In an embodiment of the heat exchanger assembly 20, the other of the outlet end caps 72 is aluminum for facilitating brazing. In another embodiment of the heat exchanger assembly 20, the other of the outlet end caps 72 is copper for allowing the use of thinner gage for facilitating the formation of more intricate shapes. For brazed joints it is preferred to have aluminum over copper so that the aluminum will shrink into the copper due to its higher coefficient of thermal expansion as the joint cools down from the joining process.

A pair of inlet end caps 76 is each sealed about one of the inlet header end portions 34 of the inlet header 30 to seal the inlet cavity 32 about the inlet header end portions 34. At least one of the inlet end caps 76 defines a second aperture 78 for receiving a refrigerant. The inlet end caps 76 can be sealed externally or internally to the inlet header end portion 34. In an embodiment of the heat exchanger assembly 20, the inlet end caps 76 are aluminum for facilitating brazing. In another embodiment of the heat exchanger assembly 20, the inlet end caps 76 are copper for allowing the use of thinner gage for facilitating the formation of more intricate shapes. For brazed joints it is preferred to have aluminum over copper so that the aluminum will shrink into the copper due to its higher coefficient of thermal expansion as the joint cools down from the joining process.

Figure 4:
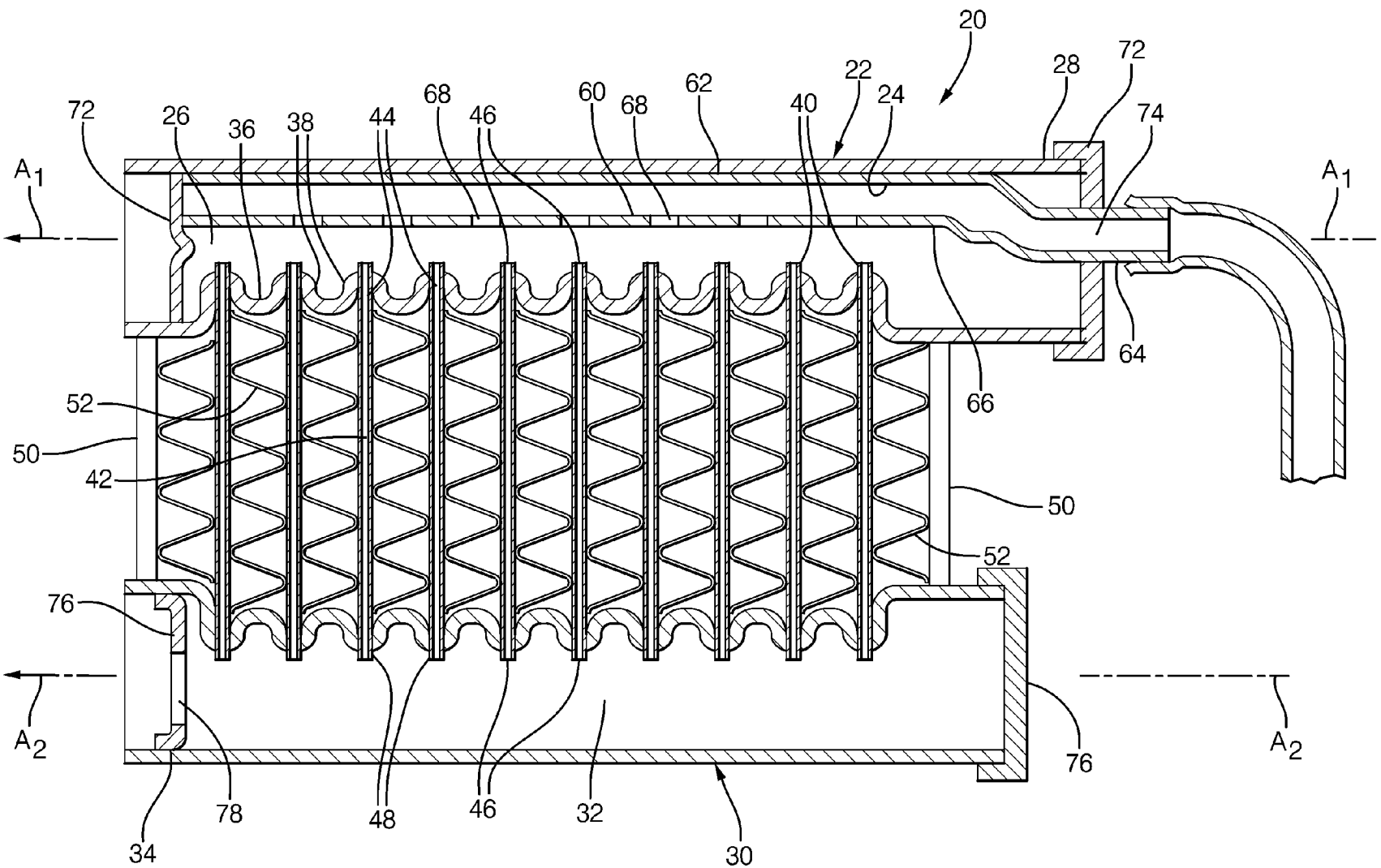
FIG. 4 is a cross sectional view of a second embodiment of the heat exchanger assembly.
Figure 5:
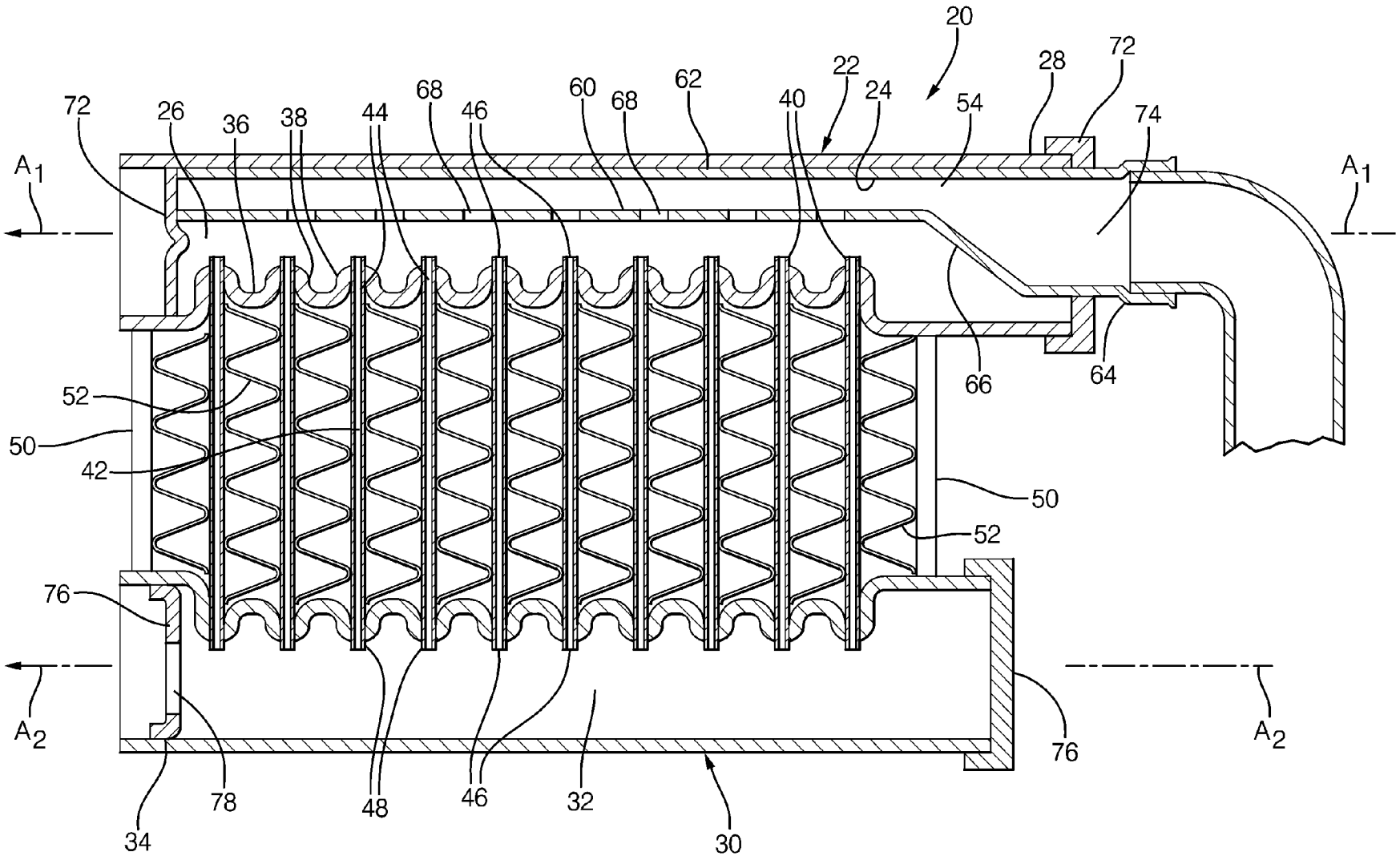
FIG. 5 is a cross sectional view of a third embodiment of the heat exchanger assembly.
Figure 6:
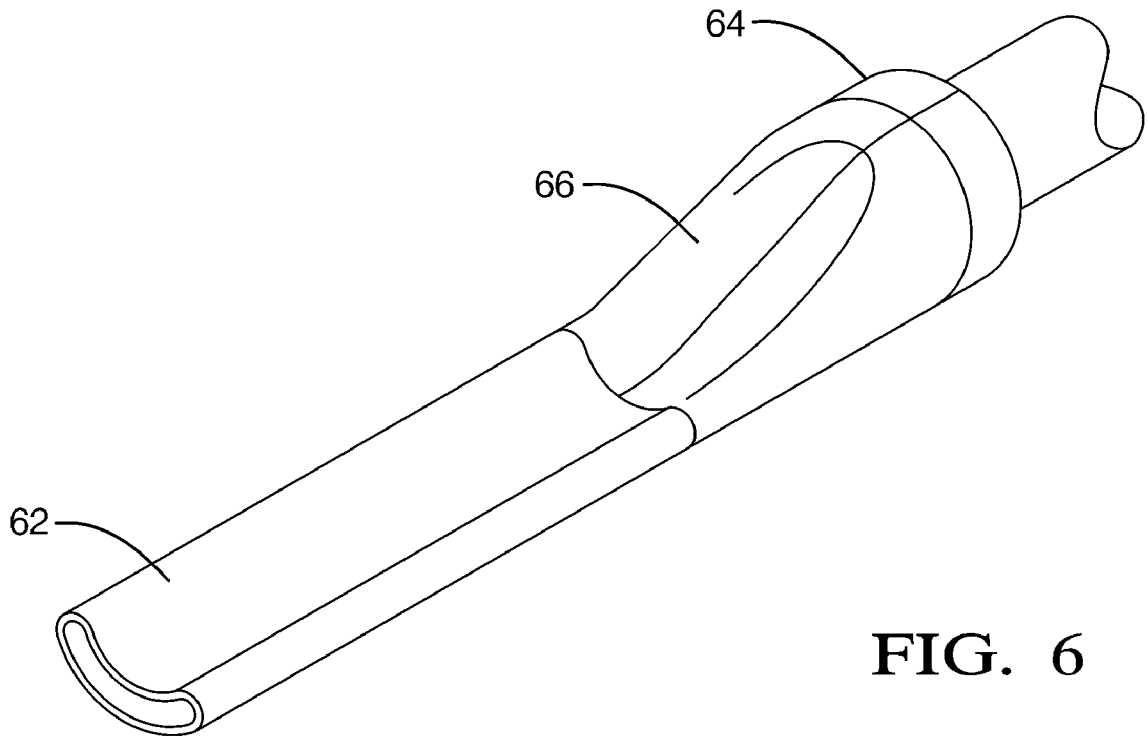
FIG. 6 is a perspective view of the conduit and the conduit end portion being connected by a transition portion.
Figure 7:
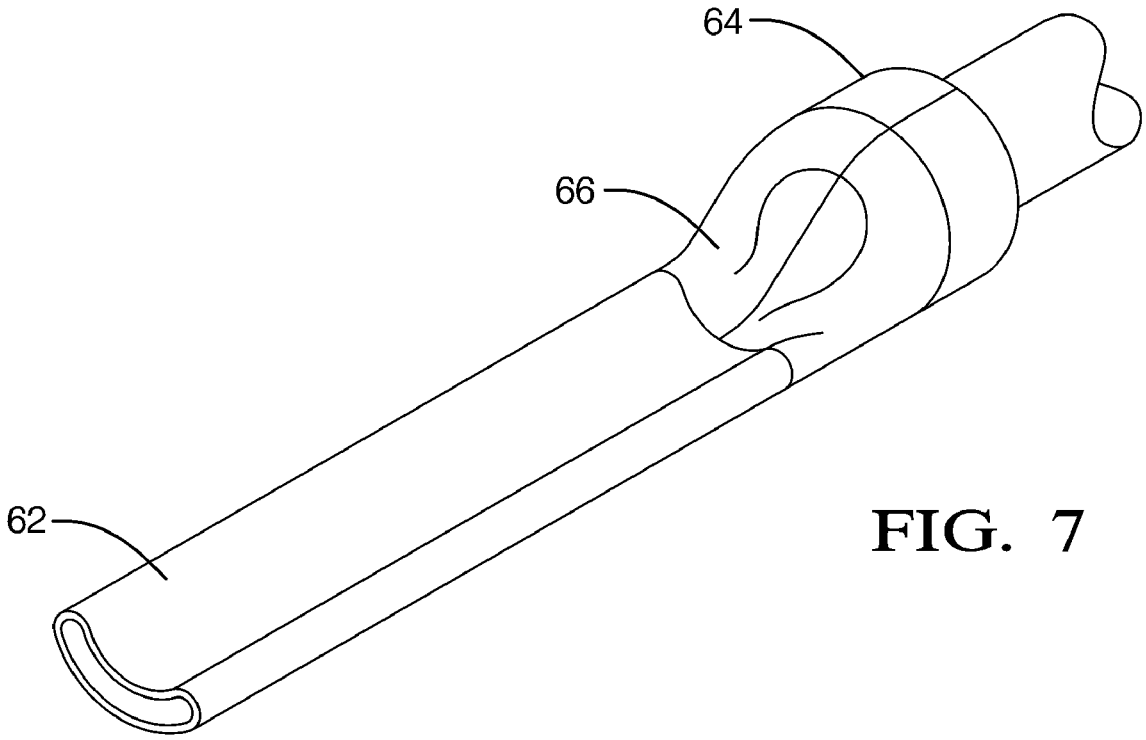
FIG. 7 is a perspective view of the conduit and the conduit end portion being connected by a transition portion.
Figure 9:
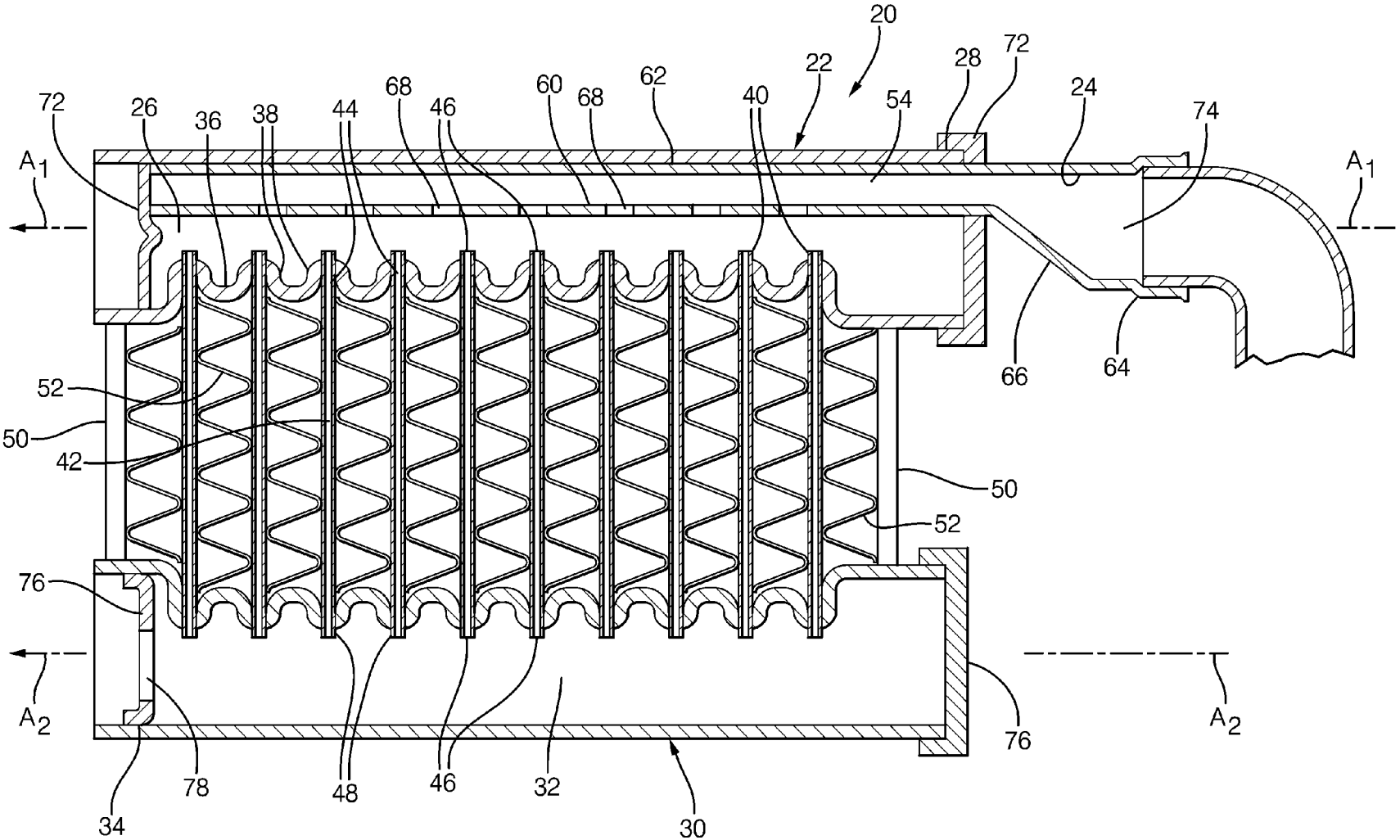
FIG. 9 is a cross sectional view of a fourth embodiment of the heat exchanger assembly.
Figure 10:
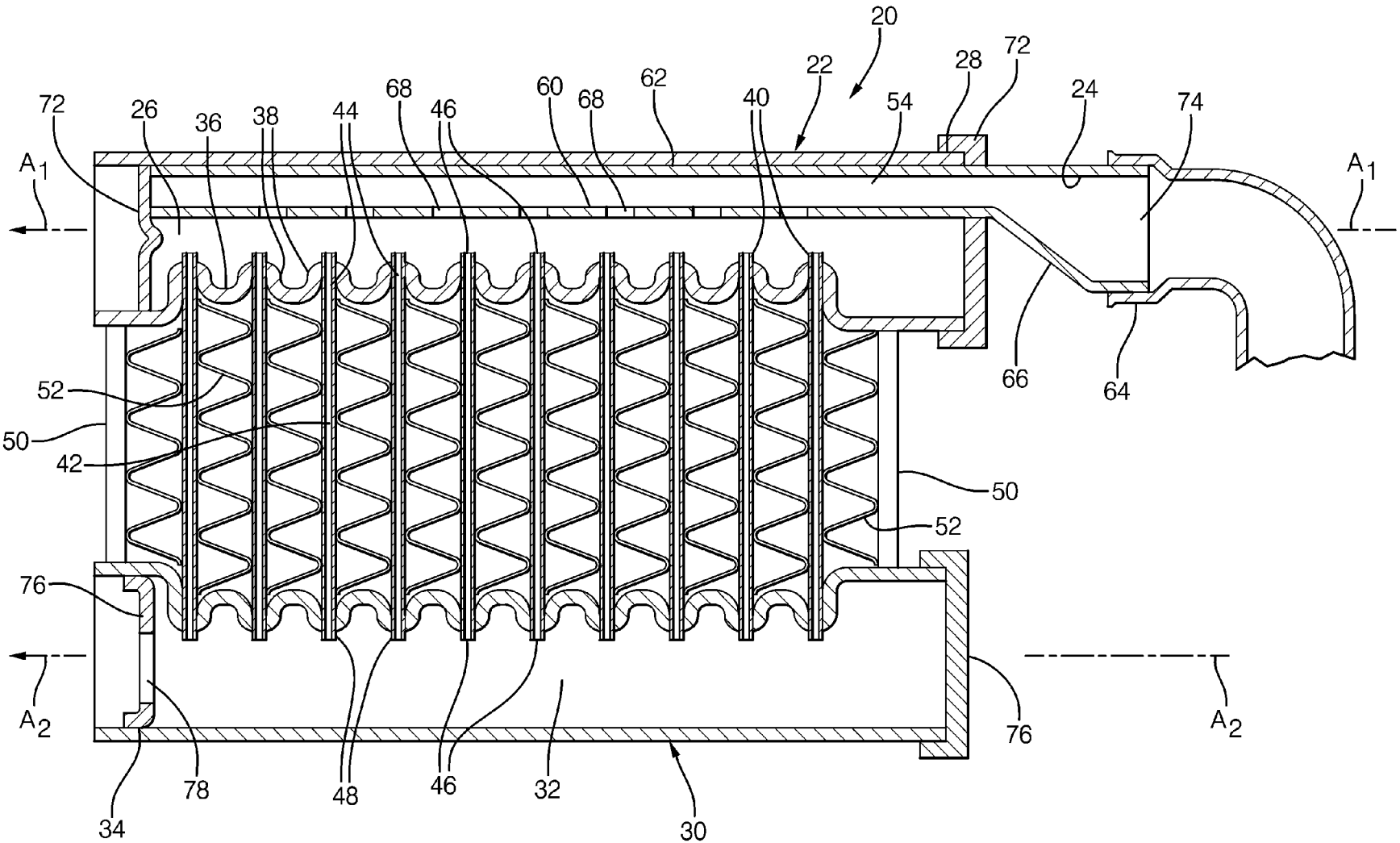
FIG. 10 is a cross sectional view of a fifth embodiment of the heat exchanger assembly.

As shown in FIG. 4, the transition portion 66 may include an offset bend to engage the conduit body portion 62. The conduit body portion 62 is offset from the conduit end portion 64 in the first cavity 26. As shown in FIG. 5, the conduit end portion 64 may also align with and abut the interior surface 24 of the first cavity 26. In this instance, the transition portion 66 is angled upwardly to connect the end portion 64 to the conduit body portion 62 at the chord surface 60. In both instances, the transition portion 66 increases in cross-sectional area from the conduit body portion 62 to the conduit end portion 64. FIG. 6 and 7 also show the transition portions connecting a circular conduit end portion 64 to a semi-circular or kidney shaped conduit body portion 62. This gradual transition lowers the refrigerant pressure drop and increases the performance of the heat exchanger. An additional pressure drop reduction may be obtained by chamfering or doming the end cap 72, 76. The transition section also provides efficient plumbing access from the end cap to the distributor tube. The transition portion 64 may be offset from the conduit end portion 64 outside of the first cavity 26 as shown in FIGS. 9 and 10.

The method includes the step of placing the outlet header 22 and the inlet header 30 in a stacker headering station fixture.

The method includes the step of interleaving cooling fins 52 between a plurality of refrigerant tubes 42 each defining a fluid passage 46 to define a fin matrix. The cooling fins 52 can be serpentine fins or any other fins known in the art. The method also includes the step of disposing a pair of core reinforcements 50 outwards of the fin matrix to define a core assembly. The core reinforcements 50 protect the cooling fins 52 and provide structural support.

The core assembly is transferred to the stacker headering station the headers 22, 30 are pressed onto the fin matrix for extending the refrigerant tubes 42 through the header slots 40 and into the cavities 26, 32 to fluidly communicate the fluid passages 46 with the cavities 26, 32. The refrigerant tubes 42 are spaced from the chord surface 60 of the conduit body portion 62 of the collector conduit 54.

The method also includes the steps of furnace brazing the headers 22, 30 and core assembly. The refrigerant tubes 42 are brazed to the headers 22, 30 and the cooling fins 52 are brazed to the core reinforcements 50 and the refrigerant tubes 42. In various embodiments of the heat exchanger assembly 20, the elements of the heat exchanger assembly 20 may consist of different materials depending upon the requirements of the heat exchanger assembly 20. For brazed joints, it is preferred to have aluminum over copper so that the aluminum will shrink into the copper due to its higher coefficient of thermal expansion as the joint cools down from the joining process. However, an aluminum to copper joint generally must be protected to provide corrosion shielding of the aluminum to copper joint in a controlled heat exchanger manufacturing process as opposed to the variable environment associated with field installation. After brazing, the heat exchanger assembly 20 is tested for leaks.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A heat exchanger assembly for transferring heat comprising:

a first header being generally cylindrical in cross-section to define a first cavity extending along a first header axis between a pair of first header end portions;

a second header defining a second cavity extending along a second header axis ($A_2$) between a pair of second header end portions;

said headers each defining a plurality of header slots;

a plurality of refrigerant tubes each extending between said header slots and defining a fluid passage extending between a pair of refrigerant tube ends;

each fluid passage being in fluid communication with said cavities for transferring refrigerant from one of said cavities to the other of said cavities;

a refrigerant conduit having a conduit cross-section and disposed in said first cavity and extending along said first header axis;

said conduit cross-section being generally semi-circular defining an arced surface and a chord surface;

said refrigerant conduit including a plurality of orifices in fluid communication with said first cavity for transferring the refrigerant between said refrigerant conduit and said first cavity; and said refrigerant conduit defining a conduit body portion and at least one conduit end portion having a circular cross-section;

said conduit body portion being offset from said conduit end portion; and a conduit transition portion interconnecting said conduit body portion and said conduit end portion.

2. The assembly as set forth in claim 1 wherein said first header has an interior surface and wherein said arced surface of said conduit body portion engages said interior surface.

3. The assembly as set forth in claim 2 wherein said conduit body portion being offset from said conduit end portion in said first cavity.

4. The assembly as set forth in claim 2 wherein said transition portion increases in cross-sectional area from said conduit body portion to conduit end portion.

5. The assembly as set forth in claim 2 wherein one of said refrigerant tube ends of each refrigerant tube extends through one of said header slots of said first header and into said first cavity and wherein said chord surface of said conduit body portion is spaced from said refrigerant tube ends extending through said header slots and into said first cavity.

6. The assembly as set forth in claim 5 wherein said chord surface is parallel to said refrigerant tube ends extending through said header slots and into said first cavity.

7. The assembly as set forth in claim 5 wherein said chord surface is arcuate and extends away from said refrigerant tube ends extending through said header slots and into said first cavity and towards said arced surface.

8. The assembly as set forth in claim 5 wherein said arced surface and said chord surface are interconnected with rounded ends.

9. The assembly as set forth in claim 2 wherein said conduit end portion extends coaxially with said first header axis in one of said first header end portions to provide a central opening for the refrigerant.

10. The assembly as set forth in claim 9 wherein said conduit body portion and said conduit transition portion extend parallel to said first header axis between said first header end portions and wherein said conduit end portion extends along said first header axis in one of said first header end portions.

11. The assembly as set forth in claim 9 wherein said first header includes a plurality of support projections extending into said first cavity under said conduit body portion for positioning said refrigerant conduit.

12. The assembly as set forth in claim 11 wherein said support projections are spaced from one another and aligned in two rows each parallel to said first header axis.

13. The assembly as set forth in claim 9 wherein said first header includes a lanced surface being flat and extending parallel to said first header axis between said first header end portions and wherein said lanced surface includes a plurality of truncated projections extending into said first cavity and being axially spaced from one another between said first header end portions to define valleys between adjacent truncated projections for defining said header slots.

14. The assembly as set forth in claim 9 wherein each refrigerant tube has a generally rectangular cross-section and includes at least one divider for supporting said refrigerant tube and for defining a plurality of said fluid passages extending between said refrigerant tube ends.

15. The assembly as set forth in claim 9 including a pair of core reinforcements disposed outwards of said refrigerant tubes and extending between said headers in a parallel and spaced relationship to said refrigerant tubes.

16. The assembly as set forth in claim 15 including a plurality of fins disposed between adjacent refrigerant tubes and between and connected to said core reinforcements and the next adjacent of said refrigerant tubes for transferring heat to and from said refrigerant tubes.

17. The assembly as set forth in claim 9 including;

a pair of first end caps each engaged and hermetically sealed to one of said first header end portions and to said refrigerant conduit;

at least one of said first end caps defining a first aperture being in fluid communication with said conduit end portion; and a pair of second end caps each engaged and hermetically sealed to one of said second header end portions with at least one of said second end caps defining a second aperture in fluid communication with said second cavity.

18. The assembly as set forth in claim 17 wherein one of said first end caps are tapered to abut said first aperture for reducing the pressure drop across said conduit end portion and said first aperture and wherein said conduit end portion has a larger diameter than said aperture.

19. The assembly as set forth in claim 18 including an end flare disposed around and connecting said conduit end portion and said first aperture of first end cap.

20. A heat exchanger assembly for transferring heat comprising;

a first header having an interior surface and being generally cylindrical in cross-section to define a first cavity for collecting refrigerant vapor and extending along a first header axis between a pair of first header end portions;

a second header defining a second cavity for receiving a refrigerant for liquid-to-vapor transformation and extending along a second header axis between a pair of second header end portions;

said second header axis being parallel to said first header axis;

each header including a lanced surface being flat and extending parallel to said corresponding header axis between said corresponding header end portions;

each lanced surface including a plurality of truncated projections extending into said corresponding cavity and being axially spaced from one another between said corresponding header end portions to define valleys between adjacent truncated projections and defining a plurality of header slots extending transversely to said header axes;

a plurality of refrigerant tubes each extending between a pair of refrigerant tube ends and extending in spaced and parallel relationship and transversely to said header axes between said headers;

each of said refrigerant tubes having a generally rectangular cross-section and including at least one divider for supporting said refrigerant tube and defining a plurality of fluid passages extending between said refrigerant tube ends;

each fluid passage being in fluid communication with said cavities for transferring refrigerant from said second cavity to said first cavity;

said refrigerant tube ends of each refrigerant tube extending through one of said header slots of each header and into said corresponding cavity;

a pair of core reinforcements disposed outwards of said refrigerant tubes and extending between said headers in a parallel and spaced relationship to said refrigerant tubes;

a plurality of fins disposed between adjacent refrigerant tubes and between each core reinforcement and the next adjacent of said refrigerant tubes for transferring heat from said refrigerant tubes;

a refrigerant conduit having a conduit cross-section and disposed in said first cavity and extending along said first header axis;

said conduit cross-section being generally semi-circular defining an arced surface and a chord surface interconnected with rounded ends;

said refrigerant conduit including a plurality of orifices in fluid communication with said first cavity for transferring the refrigerant vapor from said first cavity to said refrigerant conduit to flow the refrigerant vapor along said refrigerant conduit;

said first header including a plurality of support projections extending into said first cavity under said refrigerant conduit for positioning said refrigerant conduit;

said support projections spaced from one another and aligned in two rows each parallel to said first header axis;

a pair of first end caps each engaged and hermetically sealed to one of said first header end portions and to said refrigerant conduit;

at least one of said first end caps defining a first aperture being in fluid communication with said refrigerant conduit for venting the refrigerant;

a pair of second end caps each engaged and hermetically sealed to one of said second header end portions with at least one of said second end caps defining a second aperture in fluid communication with said second cavity for receiving the refrigerant;

said arced surface of said conduit body portion engaged to said interior surface of said cylindrical first header and said chord surface of said conduit body portion being spaced from said refrigerant tube ends extending through said header slots and into said first cavity;

said conduit end portion extending coaxially with said first header axis in one of said first header end portions to provide a central outlet for the refrigerant vapor; and said conduit body portion and said conduit transition portion extending along said first header axis between said first header end portions and said conduit end portion extending along said first header axis in one of said first header end portions;

said refrigerant conduit defining a conduit body portion and at least one conduit end portion having a circular cross-section;

said conduit body portion being offset from said conduit end portion in said first cavity; and a conduit transition portion interconnecting said conduit body portion and said conduit end portion.

21. The assembly as set forth in claim 20 wherein said chord surface is parallel to said refrigerant tube ends extending through said header slots and into said first cavity.

22. The assembly as set forth in claim 20 wherein said chord surface is arcuate and extends away from said refrigerant tube ends extending through said header slots and into said first cavity and towards said arced surface.

23. A method for fabricating a heat exchanger assembly comprising the steps of;

puncturing a generally cylindrical first header defining a first cavity and a generally cylindrical second header defining a second cavity in predetermined spaced intervals to define a plurality of header slots spaced along each header;

producing a plurality of orifices in a generally cylindrical refrigerant conduit having a conduit cross-section and a conduit body portion and a conduit end portion;

flattening a portion of the generally cylindrical refrigerant conduit to define the conduit cross-section as being generally semi-circular defining an arced surface and a chord surface;

inserting the refrigerant conduit into the first cavity of the first header;

engaging the arced surface of the conduit body portion of the refrigerant conduit with the first header;

positioning the conduit end portion of the refrigerant conduit centrally in the first header;

placing the first header and the second header in a stacker headering station fixture;

pressing the headers onto a plurality of refrigerant tubes each defining a fluid passage for extending the refrigerant tubes through the header slots and into the cavities to fluidly communicate the fluid passages with the cavities;

spacing the refrigerant tubes from the chord surface of the conduit body portion of the refrigerant conduit; and offsetting the conduit end portion of the refrigerant conduit from the conduit body portion of the refrigerant conduit before said inserting the refrigerant conduit into the first cavity step.

24. The method as set forth in claim 23 including the step of forming a groove in the flattened portion of the refrigerant conduit to define the chord surface as being arcuate before said offsetting the conduit end portion step.

25. The method as set forth in claim 23 including the step of producing a plurality of support projections spaced from one another and aligned in two rows on the first header and extending into the first cavity for contacting and supporting the conduit body portion of the refrigerant conduit after said inserting the refrigerant conduit into the first header step.

26. The method as set forth in claim 23 including the steps of positioning the conduit body portion of the refrigerant conduit between a pair of first header end portions of the first header and positioning the conduit end portion centrally in one of the first header end portions of the first header.

27. The method as set forth in claim 26 including the steps of;

sealing one of a pair of first end caps about one of the first header end portions of the first header to seal the first cavity about one of the first header end portions;

fluidly communicating the conduit end portion of the refrigerant conduit with a first aperture defined by the other of the pair of first end caps; and sealing the other of the pair of first end caps about the other of the first header end portions and about the conduit end portion of the refrigerant conduit to seal the first cavity about the other of the first header end portions.

28. A method for fabricating a heat exchanger assembly comprising the steps of;

oiling a pair of first header end portions of a generally cylindrical first header defining a first cavity and a pair of second header end portions of a generally cylindrical second header defining a second cavity;

sealing one of a pair of first end caps about one of the first header end portions of the first header to seal the first cavity about one of the first header end portions;

puncturing the first header and the second header in predetermined spaced intervals axially along each header to define a plurality of header slots spaced axially along each header;

cutting a generally cylindrical tube to define a refrigerant conduit having a conduit cross-section and a conduit body portion and a conduit end portion;

producing a plurality of orifices in the conduit body portion of the refrigerant conduit;

flattening a portion of the generally cylindrical refrigerant conduit to define the conduit cross-section as being generally semi-circular defining an arced surface and a chord surface;

inserting the refrigerant conduit into the first cavity of the first header;

engaging the arced surface of the conduit body portion of the refrigerant conduit with the first header;

positioning the conduit end portion of the refrigerant conduit centrally in the other of the first header end portions;

producing a plurality of support projections spaced from one another and aligned in two rows on the first header and extending into the first cavity for contacting and supporting the conduit body portion of the refrigerant conduit;

fluidly communicating the conduit end portion of the refrigerant conduit with a first aperture defined by the other of the pair of first end caps;

sealing the other of the pair of first end caps about the other of the first header end portions and about the conduit end portion of the refrigerant conduit to seal the first cavity about the other of the first header end portions;

sealing a pair of second end caps with at least one of the end caps defining a second aperture about the second header end portions of the second header to seal the second cavity about the second header end portions;

placing the first header and the second header in a stacker headering station fixture;

interleaving fins between a plurality of refrigerant tubes each defining a fluid passage to define a fin matrix;

disposing a pair of core reinforcements outwards of the fin matrix to define a core assembly;

transferring the core assembly to the stacker headering station;

pressing the headers onto the fin matrix for extending the refrigerant tubes through the header slots and into the cavities to fluidly communicate the fluid passages with the cavities;

spacing the refrigerant tubes from the chord surface of the conduit body portion of the refrigerant conduit;

furnace brazing the headers and core assembly;

leak testing the heat exchanger assembly; and offsetting the conduit end portion of the refrigerant conduit from the conduit body portion of the refrigerant conduit before said inserting the refrigerant conduit into the first cavity step.

29. The method as set forth in claim 28 including the step of forming a groove in the flattened portion of the refrigerant conduit to define the chord surface as being arcuate.

* * * * *